US007090733B2

(12) United States Patent
Munir et al.

(10) Patent No.: US 7,090,733 B2
(45) Date of Patent: Aug. 15, 2006

(54) METALLIC GLASSES WITH CRYSTALLINE DISPERSIONS FORMED BY ELECTRIC CURRENTS

(75) Inventors: Zuhair A. Munir, Davis, CA (US); Troy B. Holland, Davis, CA (US); Jörg F. Löffler, Davis, CA (US)

(73) Assignee: The Regents of the University of California, Oakland, CA (US)

( * ) Notice: Subject to any disclaimer, the term of this patent is extended or adjusted under 35 U.S.C. 154(b) by 245 days.

(21) Appl. No.: 10/464,060

(22) Filed: Jun. 17, 2003

(65) Prior Publication Data

US 2006/0137778 A1 Jun. 29, 2006

(51) Int. Cl.
*C22F 3/00* (2006.01)

(52) U.S. Cl. ..... 148/561; 148/566

(58) Field of Classification Search ..... 148/561, 148/566

See application file for complete search history.

(56) References Cited

U.S. PATENT DOCUMENTS

| | | | | |
|---|---|---|---|---|
| 5,287,910 | A | 2/1994 | Colvin et al. | |
| 5,288,344 | A | 2/1994 | Peker et al. | |
| 5,368,659 | A | 11/1994 | Peker et al. | |
| 5,405,458 | A | 4/1995 | Yamagata et al. | |
| 5,423,923 | A | 6/1995 | Yamagata et al. | |
| 5,482,580 | A | 1/1996 | Scruggs et al. | |
| 5,509,978 | A | 4/1996 | Masumoto et al. | |
| 5,567,251 | A | 10/1996 | Peker et al. | |
| 5,567,532 | A | 10/1996 | Peker et al. | |
| 5,618,359 | A | 4/1997 | Lin et al. | |
| 5,711,363 | A | 1/1998 | Scruggs et al. | |
| 5,772,803 | A | 6/1998 | Peker et al. | |
| 5,797,443 | A | 8/1998 | Lin et al. | |
| 5,866,254 | A | 2/1999 | Peker et al. | |
| 5,896,642 | A | 4/1999 | Peker et al. | |
| 5,950,704 | A | 9/1999 | Johnson et al. | |
| 6,001,193 | A | 12/1999 | Kojima et al. | |
| 6,021,840 | A | 2/2000 | Colvin | |
| 6,034,450 | A | 3/2000 | Kojima et al. | |
| 6,070,643 | A | 6/2000 | Colvin | |
| 6,171,410 | B1 | 1/2001 | Kojima et al. | |
| 6,235,129 | B1 | 5/2001 | Kojima et al. | |
| 6,261,386 | B1 | 7/2001 | Perepezko et al. | |
| 6,261,420 | B1 * | 7/2001 | Kubota et al. | 204/157.4 |
| 6,306,228 | B1 | 10/2001 | Inoue et al. | |
| 6,425,961 | B1 | 7/2002 | Kojima et al. | |
| 6,446,558 | B1 | 9/2002 | Peker et al. | |
| 6,562,156 | B1 | 5/2003 | Liu | |
| 6,592,689 | B1 | 7/2003 | Hays | |
| 6,835,608 | B1 * | 12/2004 | Jang et al. | 438/166 |

OTHER PUBLICATIONS

Asoka-Kumar et al., "Detection of currnet-induced vacancies in tin aluminum-copper lines using positrons", *Appl. Phys. Lett.* 68:3: 406-408 (1996).

Bertolino et al., "Electromigration effects in Al-Au Multilayers", *Scripta mater* 44: 737-742 (2001).

(Continued)

*Primary Examiner*—George Wyszomierski
(74) *Attorney, Agent, or Firm*—Townsend and Townsend and Crew LLP

(57) ABSTRACT

Metallic glasses of superior mechanical and magnetic properties are manufactured by annealing the glasses under the influence of an electric current to convert the glass to a composite that includes crystallites, preferably nanocrystallites, dispersed through an amorphous matrix.

24 Claims, 3 Drawing Sheets

OTHER PUBLICATIONS

Bertolino et al., "High-flux current effects in interfacial reactions in Au-Al multilayers", *Philosophical Magazine* 82:8: 969-985 (2002).
Danzig et al., "Small angle neutron scattering investigation of partially crystallized $Fe_{78.5-x}B_7CuNb_x$ alloys", *J. Phys. Condens. Matter* 10: 5267-5276 (1998).
Hays et al., "Microstructure Controlled Shear Band Pattern Formation and Enhanced Plasticity of Bulk Metallic Glasses Containing *in situ* Formed Ductile Phase Dendrite Dispersions", *Physical Review Letters* 84:13: 2901-2904 (2000).
Hu et al., "Glass forming ability and in-situ composite formation in Pd-based bulk metallic glasses", Acta Materialia 51: 561-572 (2003).
Inoue et al., "Preparation and Thermal Stability of Bulk Amorphous $Pd_{40}Cu_{30}Ni_{10}P_{20}$ Alloy Cylinder of 72 mm in Diameter", *Materials Transactions* 38:2: 179-183 (1997).
Löffler, "Bulk metallic glasses", *Intermetallics* 11: 529-540 (2003).
Löffler et al., "Comparison of the Decomposition and Crystallization Behavior of Zr and Pd Based Bulk Amorphous Alloys", *Journal of Metastable and Nanocrystalline Materials* 8: 179-184 (2000).
Löffler et al., "Concentration and temperature dependence of decomposition in supercooled liquid alloys", *J. Appl. Cryst.* 33: 500-503 (2000).
Löffler et al., "Grain-size dependence of intergranular magnetic correlations in nanostructured metals", *J. Appl. Cryst.* 33: 451-455 (2000).
Löffler et al., "Model for decomposition and nanocrystallization of deeply undercooled $Zr_{41.2}Ti_{13.6}Cu_{12.5}Ni_{10}Be_{22.5}$", *Applied Physics Letters* 76:23: 3394-3396 (2000).
Munir, "The effects of external electric fields on the nature and properties of materials synthesized by self-propagating combustion", *Materials Science and Engineering* A287: 125-137 (2000).
Munir, "Field Effects in Self-Propagating Solid-State Reactions", *Zeitschrift fur Physikalische Chemie, Bd.* 207: S. 39-57 (1998).
Murty et al., "Influence of Oxygen on the Crystallization Behavior of $Zr_{65}Cu_{27.5}Al_{7.5}$ and $Zr_{66.7}Cu_{33.3}$ Metallic Glasses", *Acta mater.* 48: 3985-3996 (2000).
Schneider et al., "Formation of nanocrystals based on decomposition in the amorphous $Zr_{41.2}Ti_{13.8}Cu_{12.5}Ni_{10}Be_{22.5}$ alloy", *Appl. Phys. Lett.* 68:4: 493-496 (1996).
Gerald et al., "Decomposition and crystallization of the bulk amorphous $Zr_{11}Ti_{34}Cu_{47}Ni_8$ alloy studied by SANS", *Physica B* 234-236: 995-996 (1997).
Takemoto et al., Effects of Passing Electric Current on the Elastic Property of Amorphous $Cu_{50}Zr_{50}$ and $Cu_{50}Tu_{50}$, *Acta mater.* 44:7:2787-2795 (1996).
Tkatch et al., "Delayed nucleation in $Fe_{40}Co_{40}P_{14}B_6$ metallic glass", *Materials Science and Engineering* A337: 187-193 (2002).
Zhang et al., "Structural evolution and property changes in $Nd_{80}Al_{10}Fe_{20}Co_{10}$ bulk metallic glass during crystallization", *Applied Physics Letters* 81:23: 4371-4373 (2002).
Zhou et al., "Formation of a nanostructure in a low-carbon steel under high current density electropulsing", *J. Mater. Res.*, 17:5: 921-924 (2002).
Duan, Gang et al.; "High Cooper Content Bulk Glass Formation in Bimetallic Cu-Hf System"; 2005, *Metallurgical and Materials Transactions*, vol. 36A, pp. 455-458.

* cited by examiner

METALLIC GLASSES WITH CRYSTALLINE DISPERSIONS FORMED BY ELECTRIC CURRENTS

STATEMENT AS TO RIGHTS TO INVENTIONS MADE UNDER FEDERALLY SPONSORED RESEARCH OR DEVELOPMENT

This invention was made with Government support by Grant No. DAAD19-01-1-0493, awarded by the Army. The Government has certain rights in this invention.

BACKGROUND OF THE INVENTION

1. Field of the Invention

This invention resides in the fields of metallic glasses and nanotechnology, and particularly in methods for strengthening metallic glasses by the incorporation of crystalline particles in the glassy matrix.

2. Description of the Prior Art

Metallic glasses are known to be superior to conventional metals by virtue of the improved mechanical properties of the glasses, including their higher tensile strength, fatigue strength, hardness, axial fatigue, and fracture toughness. These qualities, combined with a mid-range density, have resulted in metallic glasses being used for certain high-performance and high-impact applications. Examples of products that have been manufactured from metallic glasses are aeronautical and industrial turbo-engines, airframes, knives, golf-club heads, and even wristwatches.

Metallic glasses are alloys that have an amorphous microstructure. The amorphous state is achieved by cooling the alloy composition from a melt at a cooling rate that is fast enough to avoid crystallization. In the early investigations of metallic glasses, the alloys that were used required cooling rates of $10^4$–$10^6$ degrees Celsius per second (also designated as "K/s") to bypass crystallization. Because of this requirement, cooling could only be performed on bodies of the melt with very small dimensions, such as layers less than 100 microns in thickness or small droplets, and the amorphous material was produced only in the form of thin ribbons or fine powders.

Subsequent investigations have led to the development of several families of alloys that can be cooled to an amorphous form at much slower cooling rates, such as $10^3$ K/s or less, and most recently cooling rates within the range of 0.1–100 K/s. Among the leading investigators in this development are A. Peker, W. L. Johnson, and A. Inoue, whose investigations are reported in the literature, notably in Peker, A., and W. L. Johnson, *Appl. Phys. Lett.* 63, 2342 (1993), and U.S. Pat. No. 5,288,344 (Peker, A., and Johnson, W. L., assigned to California Institute of Technology), issued Feb. 22, 1994, A. Inoue, notably in Inoue, A., et al., "Fabrication of Bulky Zr-Based Glassy Alloys by Suction Casting into Copper Mold," *Materials Transaction, Japan Institute of Metals* (*English Version*), vol. 36, no. 9, pp. 1184–1187 (1995), and Inoue, A., et al., "Preparation and Thermal Stability of Bulk Amorphous $Pd_{40}Cu_{30}Ni_{10}P_{20}$ Cylinder of 72 mm in Diameter," *Materials Transaction, Japan Institute of Metals* (*English Version*), vol. 38, no. 2, pp. 179–183 (1997). The contents of these and all other literature and patent citations in this specification are incorporated herein by reference.

Alloys that can form amorphous solids at these low cooling rates have led to the emergence of a class of metallic materials known as bulk metallic glasses (BMGs) since the lower critical cooling rate permits these glasses to be produced in dimensions of several centimeters. By virtue of this flexibility, BMGs are suitable for many structural and functional applications, including the larger-scale products among those listed above and components in general for the defense industries, manufacturing industries, and recreational products, as well as magnetic materials, medical instruments, and implants.

An even more recent development in BMGs is the discovery that the mechanical properties of the glasses, and the magnetic properties of those used as magnets, can be further enhanced by the dispersion of crystallites throughout the amorphous matrix of the glass. Crystallites with sizes both in the nano-scale and the micro-scale have been investigated. Methods of achieving these dispersions, particularly of nanocrystallites, and the benefits that the dispersions offer are described for example in Perepezko, J. H., et al. (Wisconsin Alumni Research Foundation), U.S. Pat. No. 6,261,386 B1 (issued Jul. 17, 2001). The methods generally consist of controlled cooling techniques that result in partial crystallization (devitrification) of the amorphous material. The crystals are thus grown by nucleation, however, which is generally accompanied by grain growth, and as noted by Perepezko et al., the quality of the resulting dispersion, particularly the number of crystals formed and their size and distribution throughout the amorphous matrix, are difficult to control. The crystals reported by Perepezko et al. are in the nano-range, i.e., 100 nm or less in diameter, which are of particular interest where a high-density dispersion is sought. To achieve nanocrystalline dispersions, the Perepezko et al. disclosure proposes the seeding of the amorphous matrix with elements that are insoluble in the amorphous matrix. This however involves the introduction of foreign matter into the melt, and requires control of the seed size, while still causing grain growth. The formation of and benefits offered by micro-range crystals are reported by Hays, C. C., et al., *Phys. Rev. Lett.* 84: 2901–4 (2000). The crystals reported in this paper are dendrites that improve the toughness and plasticity of the glasses.

SUMMARY OF THE INVENTION

It has now been discovered that a composite metallic material consisting of crystallites dispersed throughout a metallic glass matrix can be achieved with a high degree of control by annealing a metallic glass while passing an electric current, preferably a DC current, through the glass. The sizes of the crystallites and their density (i.e., volume fraction) can be controlled by adjustment of the current density. This discovery permits the formation of a composite amorphous-nanocrystalline or amorphous-microcrystalline material with a high volume fraction of crystallites with little risk of undesired crystal growth that typically accompanies devitrification in thermal annealing processes and without the introduction of foreign materials. Although applicable to amorphous systems in general, this invention is of particular interest to bulk metallic glasses.

It has further been discovered that the achievement of crystallite dispersions by this method occurs both in glasses that do not undergo phase changes during the annealing process prior to crystallization and those that do undergo phase changes. The phase changes referred to herein are redistributions of the alloy components causing changes in alloy composition while still maintaining the amorphous structure. These phase changes may be desirable or undesirable, depending on which phase is preferred and on the character and properties sought in the ultimate product.

This invention also resides in the resulting composites themselves, which are novel in view of the high degree of control that can be imposed on their manufacture. These and other features, objects, advantages, and preferred embodiments will be best understood from the description that follows.

DETAILED DESCRIPTION OF THE INVENTION AND PREFERRED EMBODIMENTS

Figure 1:
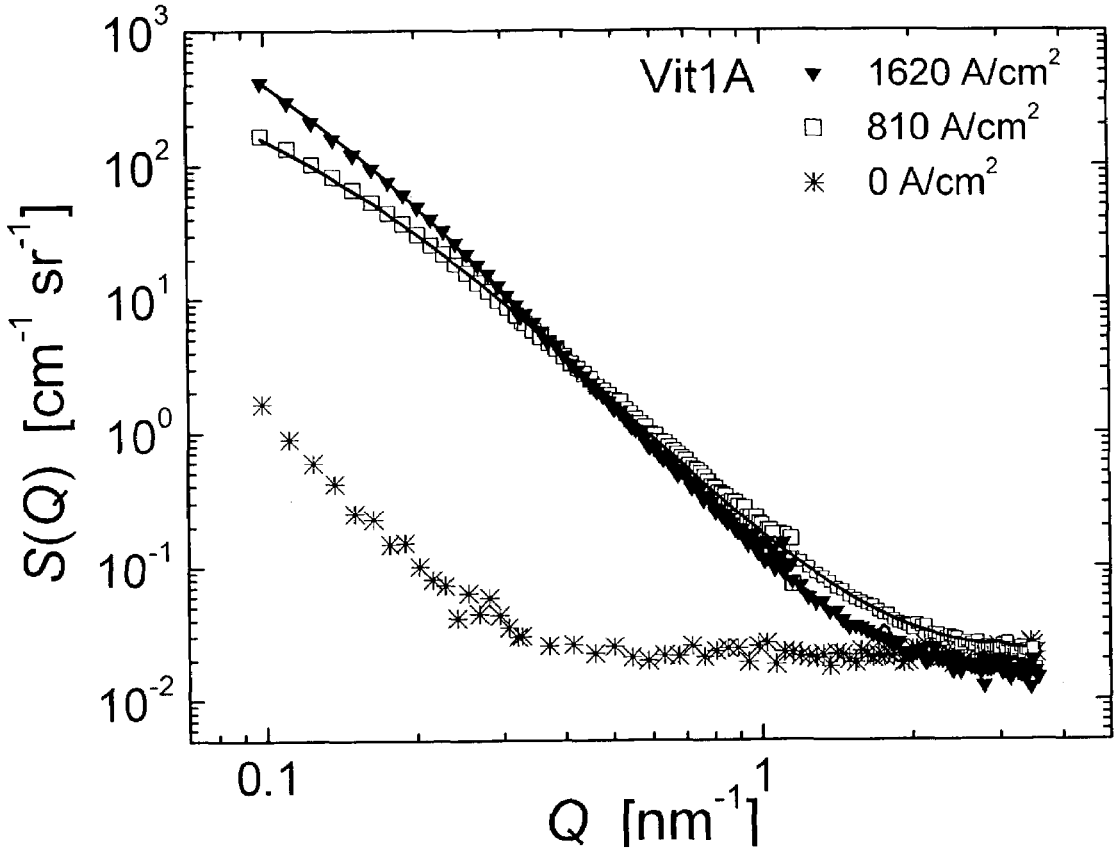
FIG. 1 presents a series of small-angle neutron scattering (SANS) scans of zirconium-based metallic glasses annealed both in the presence and absence of an electric current.

The terms "a" and "an" as used in the claims appended hereto denote "one or more," and the term "comprising" denotes "including but not limited to."

Alloy compositions to which this invention can be applied include the wide range of compositions that can form a glass upon cooling from a melt and that once formed will remain a glass upon further cooling to ambient temperature. For some alloys, as noted above, the formation of a glass by cooling from a melt requires a very fast cooling rate while for others, slower cooling rates, such as those that permit the formation of bulk metallic glasses, can be used. Among the various classes of alloys that can form a glass in this manner are:

(i) aluminum-based glasses that include transition metals and rare earth elements, (ii) iron-based, nickel-based, and cobalt-based glasses that may include transition metals and rare earth elements and in many cases, boron, (iii) zirconium-based glasses, (iv) titanium-based glasses, (v) palladium-based glasses, (vi) platinum-based glasses, and other transition-metal-based glasses that include copper, nickel, boron, or phosphorus as alloying elements, often in various combinations. Some of the more recently developed classes of glass-forming alloy systems and publications in which they are described, are the following, in which "Ln" denotes lanthanide metal and "TM" denotes transition metal:

Mg—Ln—TM—Inoue, A., et al., *Jpn. J. Appl. Phys.,* 27 (1988), L2248

Ln—Al—TM—Inoue, A., et al., *Mater. Trans. JIM* 30 (1989), 965

Zr—Al—TM—Inoue, A., et al., *Mater. Trans. JIM* 31 (1990), 177

Zr—Ti—TM—Be—Peker, A., et al., *Appl. Phys. Lett.* 63 (1993), 2342

Ti—Zr—Al—TM—Be—Inoue, A., et al., *Mater. Sci. Eng.*, A1797/A180 (1994), 210

Fe—(Al, Ga)—(P, C, B, Si)—Inoue, A., et al., *Mater. Trans. JIM* 36 (1995), 1180

Nd—Fe—Al—Inoue, A., et al., *Mater. Trans., JIM* 37 (1996), 99

Pd—Cu—Ni—P—Inoue, A., et al., *Mater. Trans. JIM* 37 (1996), 181

Co—(Al, Ga)—(P, B, Si)—Inoue, A., et al., *Mater. Trans. JIM* 37 (1996), 1332

Pr—Fe—Al—Inoue, A., et al., *Mater. Trans. JIM* 37 (1996), 1731

Nd—Fe—Al—Co—Xia, L., et al., *J. Appl. Phys. D* 36 (2003), 775

Ni—Nb—Sn—X (X=B,Fe,Cu)—Choi-Yim, H., et al., *Appl. Phys. Lett.,* 82 (2003), 1030

Ti—Cu—Zr—Ni (Vit 101)—Lin, X. H., et al., *J. Appl. Phys.* 78(1995), 6514

Zr—Ti(Nb)—Cu—Ni—Al (Vit 105, Vit 106)—Lin, X. H., et al., *Mater. Trans. JIM* 38 (1997), 473 ("Ti(Nb)" denotes Ti, Nb, or a combination of Ti and Nb)

Fe—Si—B—Nb—Cu (Finemet)—Yoshizawa, Y., et al., *J. Appl. Phys.* 64 (1988), 6044

TM—P—B (Metglass) Mizuguchi, T, et al., in *Amorphous Magnetism*, Hopper, H. O. and de Graaf, A. M., Editors, Plenum Press, New York, 1973, p. 325

Still other classes of glass-forming alloys exist, as known to those skilled in the art, and are contemplated for inclusion within the practice of the present invention. Both magnetic and non-magnetic alloys are included. The terms "[metal]-based" in which "[metal]" refers to a specified metallic element and "primary constituent" are used herein to denote the metal that constitutes the highest weight percent component of the alloy. The term "secondary constituent" denotes a component present in the alloy at a lower weight percent than the primary constituent.

One class of preferred alloy compositions is that in which the primary constituent is either zirconium or titanium or both in combination. Certain alloys of this class contain beryllium as a secondary constituent. Among these are alloys that contain zirconium and titanium in combination with beryllium, copper and nickel. Alloys of this class are available from Amorphous Technologies International (Laguna Niguel, Calif. USA) and Liquidmetal Technologies (Tampa, Fla., USA) under the name VITRELOY®. Examples of zirconium-based VITRELOY alloys that contain beryllium are Vit1 and Vit1A, examples of those that do not contain beryllium are Vit 105 (the metals of which are Zr—Ti—Ni—Co—Al) and Vit 106 (the metals of which are Zr—Nb—Ni—Co—Al), and an example of one that is copper-titanium-based is Vit 101 (the metals which are Ti—Cu—Zr—Ni). Another class of preferred alloy compositions is one in which the primary constituent is an upper transition metal that is either palladium, iron, cobalt, manganese, ruthenium, or silver. The secondary constituent(s) in this class of alloy compositions are preferably copper, nickel, or phosphorus, or two or all of these elements. A preferred subgroup of this class is the Pd—Cu—Ni—P group included in the list above, and a particularly preferred subgroup are those having the formula $Pd_{60-x}Cu_{30}Ni_{10}P_x$ where x=10–20. A third class of preferred alloy compositions is that in which the alloys include a transition metal, phosphorus, and boron. Further preferred alloy compositions are as listed above.

The starting material can be an alloy that is entirely amorphous in microstructure, or one that contains both amorphous and crystalline regions, preferably with the amorphous region constituting at least 50% by volume of the microstructure.

While the invention is applicable to any alloy composition that is capable of forming a metallic glass, preferred alloy compositions are those that have a critical cooling rate of less than about 1,000 K/s, preferably less than about 500 K/s, and most preferably within the range of about 0.1 K/s to about 100 K/s. The "critical cooling rate" is the slowest cooling rate at which the composition will form an amorphous solid upon cooling from a melt. In terms of the glass transition temperature ($T_g$), preferred alloy compositions are those that have a glass transition temperature within the range of about 250° C. to about 600° C., and most preferably within the range of about 300° C. to about 500° C., as determined at a heating rate of 10 degrees Celsius per minute. In terms of a still further parameter, the difference between the crystallization temperature and the glass transition temperature, preferred alloy compositions are those in which this difference is at least about 30 degrees Celsius (at a heating rate of 10° C./min), and most preferred are those in which the difference is at least about 50 degrees Celsius.

As noted above, alloy compositions for use in the practice of this invention can be purchased from commercial suppliers. Alternatively, the alloy compositions can be prepared by methods known in the art and disclosed in the literature. A method in current use is vacuum die casting, as described in the following United States patents naming Colvin, G., as inventor: U.S. Pat. No. 5,287,910, issued Feb. 22, 1994, U.S. Pat. No. 6,021,840, issued Feb. 8, 2000, and U.S. Pat. No. 6,070,643, issued Jun. 6, 2000.

The passage of an electric current through the glass during the annealing procedure in the practice of this invention can be achieved by conventional means. The current density, the duration of the application of the current, and the temperature maintained during the current can vary, although variations in these parameters will result in variations in the volume fraction of the crystallites formed and, in many cases, the sizes of the crystallites, which can range from several nanometers to tens of micrometers. As noted above, in cases where the sizes of the crystallites are affected by the current density and its duration, any increase in size can be readily controlled, and is considerably more controllable than in the thermal devitrification processes of the prior art. Thus, the current density and duration will be varied in accordance with the volume fraction and in some cases size of the crystallites that are desired for the product composite. In most cases, particularly when crystallites in the nano-size range are sought, best results will be obtained with current densities of at least about 100 A/cm$^2$, preferably at least about 300 A/cm$^2$, more preferably from about 300 A/cm$^2$ to about 5,000 A/cm$^2$, and most preferably from about 500 A/cm$^2$ to about 2,500 A/cm$^2$. Best results in most cases will also be achieved by applying the current for a duration of at least about 30 minutes, preferably at least about one hour, more preferably from about one hour to about eight hours, and most preferably from about two hours to about six hours. The annealing temperature at which the current is applied is preferably below the laboratory glass transition temperature (measured at a heating rate of 10 K/min), and preferably within about 25 degrees Celsius, most preferably within about 10 degrees Celsius, of the laboratory glass transition temperature. The applied current can be an alternating current (AC), a direct current (DC), or a pulsed direct current. For maximum control of the crystallite size, a DC current is preferred.

As noted above, the operating conditions can be controlled to achieve crystallites within the micro-range or the nano-range, or both. Preferably, the conditions are controlled to produce crystallites that are about 50 microns or less in diameter, preferably 1 to 30 microns in diameter, when micro-range crystallites are either acceptable or desired. When nano-range crystallites are sought, the preferred size range of the crystallites will be about 100 nanometers or less, and most preferably about 2 nanometers to about 100 nanometers.

The following examples are offered for purposes of illustration and are not intended to limit the scope of the invention.

EXAMPLES

The following experiments illustrate the use of a DC current to form crystallites in two metallic glasses. One of the glasses had the empirical formula $Zr_{42.6}Ti_{12.4}Cu_{11.25}Ni_{10}Be_{23.75}$, has a critical cooling rate of 1 K/s, a glass transition temperature of 628 K (355° C.) at a heating rate of 10 K/min, and a ΔT (the difference between the crystallization temperature and the glass transition temperature) of about 97 K, and is a glass known to undergo decomposition (phase change) before crystallization. The other glass had the empirical formula $Pd_{40}Cu_{30}Ni_{10}P_{20}$ (referred to hereinafter as "PCNP"), has a critical cooling rate of less than 1 K/s, a glass transition temperature of 582 K (309° C.) at a heating rate of 10 K/min, and a ΔT of about 88 K, and is believed to crystallize by classical nucleation and growth, i.e. without decomposition. The Zr-based glass was a product obtained from Howmet Research Corporation (Whitehall, Mich., USA) and identified by the product name Vit1A. The Pd-based glass was prepared by induction melting of Pd, $Cu_{73.4}P_{26.6}$, $Ni_2P$ and P in vacuum of $10^{-3}$ mbar inside a silica tube 5 mm in diameter, using $B_2O_3$ oxide flux, followed by quenching with water. The materials used were Pd metal pieces (99.95% purity), $Ni_2P$ powder (99.5%), copper phosphorus shots (Cu:P; 85:15 weight percent) and additional phosphorus lumps (99.999+%). The Vit1A glass sample was sectioned into rectangular sheets measuring of 3.25×3.80×0.5 mm. The PCNP glass was sectioned into circular disks 0.5 mm in thickness and 5 mm in diameter.

The sectioned samples were exposed to a DC current in an apparatus consisting of two copper electrodes surrounded by a cylindrical furnace made from tantalum sheets cut in a serpentine design as described by Bertolino, N., et al., in *Scripta Mater.* 44, 737 (2001), and *Phil. Mag. B* 82, 969 (2002). Copper foil was placed between the samples and the electrodes to ensure good contact. DC current was then applied at current densities of 810 and 1620 A/cm$^2$ for the Vit1A samples and 509 and 1018 A/cm$^2$ for the PCNP samples while the samples were annealed. Further samples of each material were annealed under identical conditions except in the absence of a current. The annealing temperatures for all samples, regardless of the presence or absence of a current or the current density, were 623 K for the Vit1A samples and 577 K for the PCNP samples. Each of these temperatures is approximately 5 K below the laboratory $T_g$ values of the respective glass. For those samples that were exposed to a current, the samples reached the steady-state temperature resulting from the Joule heating in approximately 5 minutes. Since these temperatures were lower than the desired annealing temperatures, the furnace was then activated to achieve the target annealing temperature. In all cases, the annealing temperatures were controlled to within approximately ±2 K of the target. Temperatures were monitored by a shielded and grounded Type K thermocouple in direct contact with the center of each sample. The thermocouple was calibrated by determination of the melting points of Zn and Sn.

After annealing, the samples were analyzed by small-angle neutron scattering (SANS) at the Paul Scherrer Institute (Villigen, Switzerland). Using a wavelength of λ=6 Å and sample-detector distances of 1.8 m and 8 m for the Vit1A samples, and 20 m for the PCNP samples, the Q-range covered was 0.1–3.5 $nm^{-1}$ for the Vit1A samples and 0.03–3.5 $nm^{-1}$ for the PCNP samples ($Q=4\pi \sin \theta/\lambda$, with $\theta$=half the scattering angle).

FIG. 1 shows the SANS results of the Vit1A samples in a log—log presentation. The symbols used in the plot are as follows:

- asterisks: SANS results of a sample annealed without DC current
- open squares: SANS results of a sample annealed with DC current at a current density of 810 $A/cm^2$
- filled triangles: SANS results of a sample annealed with DC current at a current density of 1620 $A/cm^2$ The data representing the samples annealed for 210 minutes at 623 K in the absence of a DC current (the asterisks) indicate only a very small scattering contribution in the low Q region. This shows that the sample is essentially amorphous after this heat treatment and still homogeneous in composition. In contrast, the data representing the samples annealed at the same conditions but under the influence of a current (the squares and triangles), show a strong scattering contribution in SANS. This indicates that the imposition of a current has a strong influence on either phase separation, crystallization, or both in this metallic glass.

For an analysis of the SANS data, SANS intensity was assumed to occur from spherical particles with log-normally distributed particle diameters. In this case, the scattering intensity is $$S(Q, R) = (\Delta\eta)^2 \int_R F_p^2(Q, R) V_p(R) N(R)\, dR$$

where $\Delta\eta$ is the scattering length density contrast, $F_p$ is the particle form factor, $V_p(R)$ is the volume of the (spherical) particle and N(R)dR is the incremental volume fraction in the size interval between R and R+dR. Assuming a log-normal distribution, N(R) can be parameterized by the amplitude A, width $\sigma$, and position $R_0$ of the log-normal distribution. The three parameters are obtained from fitting the scattering curves (the solid lines in FIG. 1) to the equation for S(Q,R) above. From the resulting log-normal distribution, a (volume-weighted) average particle diameter is obtained which is 10 nm for the sample annealed with a current of 810 $A/cm^2$, and 20 nm for the sample annealed with a current of 1620 $A/cm^2$. The scattering invariant $$\tilde{Q} = \int_0^\infty Q^2 S(Q)\, dQ$$

of the sample annealed with 1620 $A/cm^2$ is approximately 25% larger than that of the sample annealed with 810 $A/cm^2$. This indicates that the larger current results in the formation of larger particles by crystallization as well as a greater overall volume fraction of the crystalline phase. For this alloy, the resulting particles remain in the nano-size range.

Figure 2:
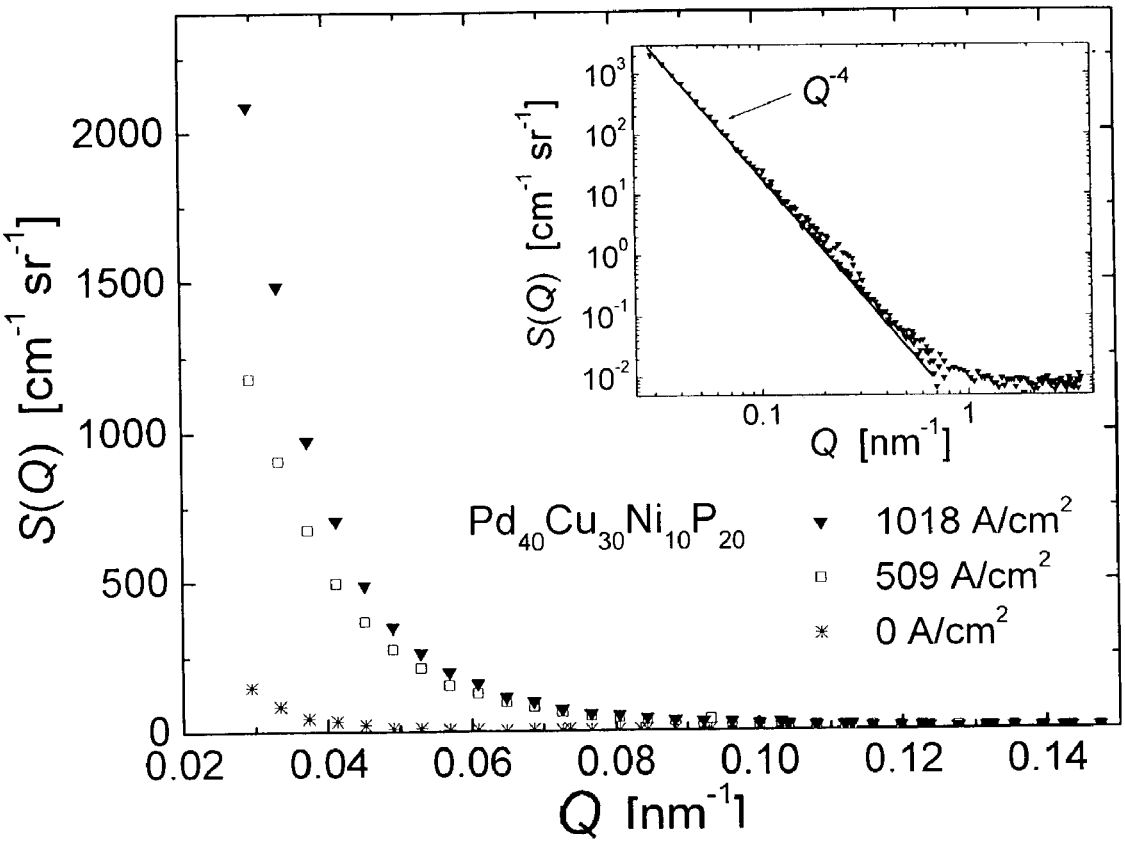
FIG. 2 presents a series of small-angle neutron scattering (SANS) scans of palladium-based metallic glasses annealed both in the presence and absence of an electric current.

FIG. 2 shows the SANS results of the PCNP samples after annealing for 210 min at 577 K. The symbols used are as follows:

- asterisks: SANS results of a sample annealed without DC current
- open squares: SANS results of a sample annealed with DC current at a current density of 509 $A/cm^2$
- filled triangles: SANS results of a sample annealed with DC current at a current density of 1018 $A/cm^2$ The plot shows that the results were similar to those obtained with the Vit1A samples: in the samples where no current was applied, annealing near the glass transition only leads to a small scattering contribution at low Q, whereas in the samples where annealing was accompanied by the application of a current, a stronger SANS intensity was observed. The log—log presentation of the sample annealed with a current of 1018 $A/cm^2$, which is included in the Figure as an inset, shows that the SANS intensity mainly follows a $Q^{-4}$ law. The exponent −4 indicates that most of the structure information was at very low Q, outside the resolution of the SANS experiment. Although the only information about the crystal size was that it exceeded 100 nm, the result shows that the crystallization behavior changes when an external current is applied.

This experiment shows that the application of an electric current can produce crystals of various sizes ranging from the nanometer range into the micrometer range. Depending on the alloy and its use, both nano-sized and micro-sized dispersions offer superior properties over microstructures that are either monolithic glasses or fully crystalline. A composite consisting of micrometer-sized crystals in a glassy matrix shows for example 5% plasticity under tensile conditions while the monolithic glass shows nearly no plasticity and fails under the formation of one dominant shear band.

Figure 3:
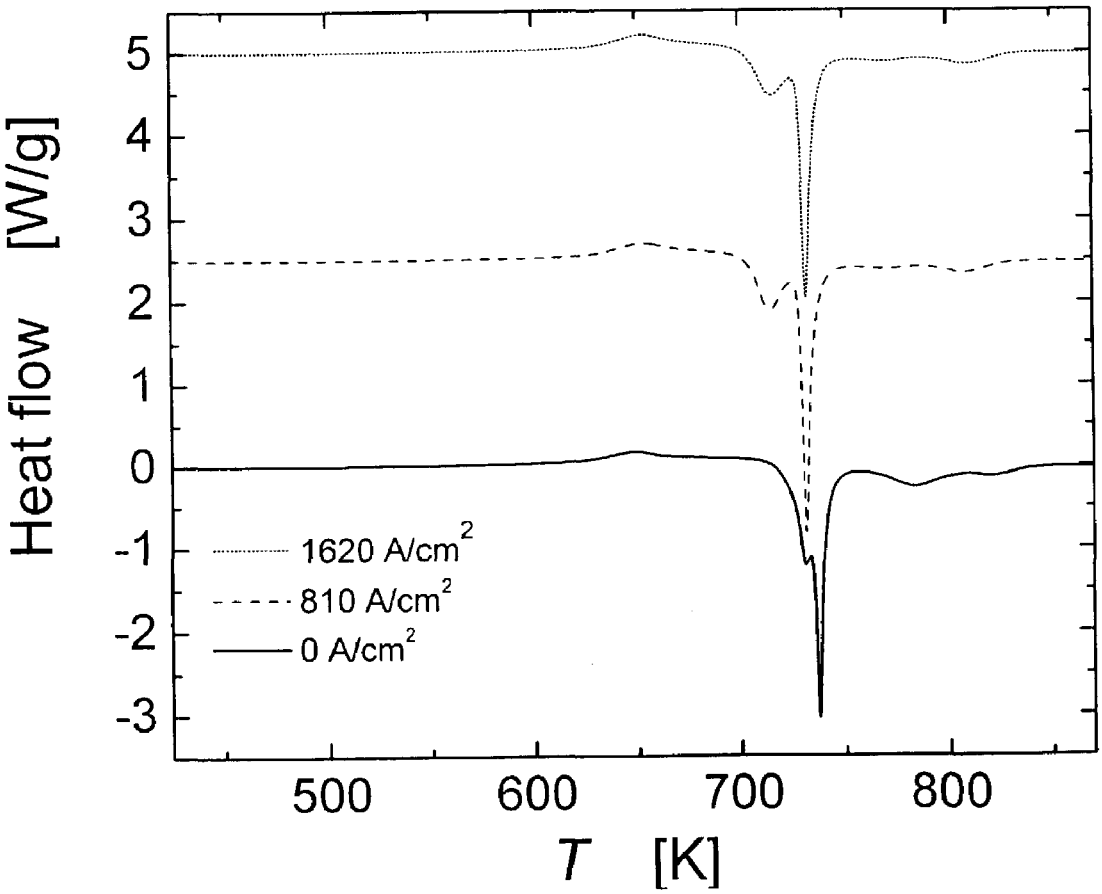
FIG. 3 presents a series of differential scanning calorimetry (DSC) scans of zirconium-based metallic glasses annealed both in the presence and absence of an electric current.

To obtain further information about the crystallization behavior, differential scanning calorimetry (DSC) was performed on Vit1A samples that had been processed and annealed in the same way as those that were analyzed by SANS. FIG. 3 shows DSC scans performed on Vit1A with a heating rate of 10° C./min. The three lines shown in the scan represent the three different annealing conditions, as follows:

- lower line: DSC scan of a sample annealed without DC current
- middle (dashed) line: DSC scan of a sample annealed with DC current at a current density of 810 $A/cm^2$
- upper (dotted) line: DSC scan of a sample annealed with DC current at a current density of 1620 $A/cm^2$ While the glass transition temperature, at $T_g$=625±3 K, is the same within experimental error for the different annealing conditions, the crystallization behavior is obviously different. The sample annealed without external current (the lower line) shows crystallization peaks centered at 731 K and 737 K, with the main crystallization peak at 737 K. In contrast, the samples annealed with a current (middle and upper lines) show a lower thermal stability. The crystallization peaks in these scans are centered at 715 K and 731 K, with the main crystallization peak at 731 K. Furthermore, the overall crystallization enthalpy of the sample annealed with a current of 1620 $A/cm^2$ (the upper line) is 77.4 J/g, which is slightly smaller than that of the sample annealed with 810 $A/cm^2$ ($\Delta H_{cryst}$=78.8 J/g) (middle line). Similar observations are made in the PCNP samples. Thus, while the glass transition does not change, modifications in the crystallization behavior are observed with variations in the current density.

In both the Vit1A samples and the PCNP samples, the SANS data for the samples annealed with current included no interference maxima, while the literature reports the occurrence of interference maxima in SANS data of samples annealed in the absence of current. The presence of interference maxima implies a phase separation process on the nanometer scale. In Vit1A, for example, Löffler, J. F., et al.,

*J. Appl. Cryst.* 33, 500 (2000), report interference maxima occurring in a temperature range between 603 and 643 K when the samples are annealed for 15 hours in the absence of a current. Only at temperatures above 643 K do these interference maxima vanish. Comparing this with the experimental data presented herein leads to the conclusion that annealing in the presence of the current can cause the glass to crystallize without a prior phase separation process on the nanometer scale. The current thus has an effect on crystallization that is similar to that resulting from an increase in temperature.

Comparing the DSC patterns in FIG. 3 with those in Löffler, J. F., et al., above (*J. Appl. Cryst.* 33, 500 (2000)), the DSC patterns of the samples annealed with current differ from those of the as-prepared Vit1A sample (i.e., entirely amorphous in microstructrure), while no such difference is observed in the DSC patterns of samples annealed without current. The DSC patterns show that the thermal stability of the samples annealed with a current is lower, with the first crystallization peak occurring at 715 K. The DSC patterns of the samples annealed with current are similar to those of Vit1, which is a variant of Vit1A (and commercially available from the same supplier), with a lower ΔT (difference between the crystallization temperature and the glass transition temperature, 72 K for Vit1 vs. 97 K for Vit1A). This implies that a (Zr,Be)-rich crystalline phase has formed, shifting the composition of the remaining glassy matrix towards that of Vit1. Indeed, the phase $Be_2Zr$ is known to be one of the stable primary phases that precipitate in Be-bearing Zr-based bulk metallic glasses. Furthermore, the crystallization enthalpy calculated from the area of the crystallization peaks decreased slightly when the current density is increased. This shows that additional crystallization occurs when the current density is increased, which is consistent with the SANS data.

As reported by Löffler, J. F., et al., *Mater. Sci. Forum* 343–346, 179 (2000), PCNP forms micrometer-sized crystals even in the deeply undercooled liquid regime and does not decompose on the nanometer scale. While SANS can only give qualitative results on the current-induced crystallization behavior, the strong increase of the SANS intensity at low Q shown in the data presented herein indicates that the current also influences the crystallization in Pd-based alloys.

To summarize, the data collectively show that electric current has a large influence on the volume fraction and crystal size in metallic glasses, and that high current densities facilitate crystallization. Since the microstructure is much easier to control with an electric current than with temperature in thermal devitrification processes of the prior art, crystallite dispersions can be formed in metallic glasses with a high degree of control over the size of the particles and the density and uniformity of the dispersion.

The foregoing descriptions are offered primarily for purposes of illustration. Further variations and substitutions in the materials and equipment used, the processing conditions, and other parameters of the system will be apparent to those of skill in the art and can be made without departing from the spirit and scope of the invention.

What is claimed is:

1. A method for the manufacture of a composite metallic material comprising a matrix of metallic glass with metallic crystallites dispersed therein, from an alloy composition that can be cooled from a melt at a cooling rate sufficient to form a glass, said method comprising annealing a bulk metallic glass of said alloy composition that will form a glass upon cooling from a melt at a cooling rate of less than about 1,000 degrees Celsius per second, while passing an electric current through said glass at a current density of at least about 300 $A/cm^2$ for at least one hour to cause the formation of crystallite dispersions of about 50 microns or less in diameter in said glass.

2. The method of claim 1 in which said crystallite dispersions are about 1 micron to about 30 microns in diameter.

3. The method of claim 1 in which said crystallite dispersions are about 100 nanometers or less in diameter.

4. The method of claim 1 in which said crystallite dispersions are from about 2 nanometers to about 100 nanometers in diameter.

5. The method of claim 1 in which said electric current is a DC current.

6. The method of claim 1 in which said alloy composition has a glass transition temperature and a crystallization temperature that exceeds said glass transition temperature by at least about 30 degrees Celsius at a heating rate of 10° C./min.

7. The method of claim 1 in which said alloy composition has a glass transition temperature and a crystallization temperature that exceeds said glass transition temperature by at least about 50 degrees Celsius at a heating rate of 10° C./min.

8. The method of claim 1 in which said alloy composition is one that will form a glass upon cooling from a melt at a cooling rate of less than about 500 degrees Celsius per second.

9. The method of claim 1 in which said alloy composition is one that will form a glass upon cooling from a melt at a cooling rate within the range of about 0.1 degree Celsius per second to about 100 degrees Celsius per second.

10. The method of claim 1 in which said alloy composition is one having a glass transition temperature within the range of about 250° C. to about 600° C., determined at a heating rate of 10 degrees Celsius per minute.

11. The method of claim 10 in which annealing is performed at a temperature that is within about 25 degrees Celsius of said glass transition temperature.

12. The method of claim 10 in which said annealing is performed at a temperature that is within about 10 degrees Celsius of said glass transition temperature.

13. The method of claim 1 in which said alloy composition is one having a glass transition temperature within the range of about 300° C. to about 500° C., determined at a heating rate of 10 degrees Celsius per minute.

14. The method of claim 1 comprising passing said DC current through said glass at a current density of about 300 $A/cm^2$ to about 5,000 $A/cm^2$ for a period of time of about one hour to about eight hours.

15. The method of claim 1 comprising passing said DC current through said glass at a current density of about 500 $A/cm^2$ to about 2,500 $A/cm^2$ for a period of time of about two hours to about six hours.

16. The method of claim 1 in which said alloy composition comprises a member selected from the group consisting of zirconium, titanium, and a combination of zirconium and titanium as a primary constituent.

17. The method of claim 1 in which said alloy composition comprises (i) a primary constituent selected from the group consisting of palladium, iron, cobalt, manganese, ruthenium, and silver, and (ii) a secondary constituent selected from the group consisting of copper, nickel, and phosphorus.

18. The method of claim 17 in which said alloy composition comprises palladium, copper, nickel and phosphorus.

19. The method of claim 1 in which said alloy composition comprises zirconium, titanium, a transition metal, and beryllium.

20. The method of claim 1 in which said alloy composition comprises titanium, copper, zirconium, and nickel.

21. The method of claim 1 in which said alloy composition comprises (i) zirconium, (ii) titanium, niobium, or a combination of titanium and niobium, (iii) copper, (iv) nickel, and (v) aluminum.

22. The method of claim 1 in which said alloy composition comprises palladium, copper, nickel, and phosphorus.

23. The method of claim 1 in which said alloy composition comprises iron, silicon, boron, niobium, and copper.

24. The method of claim 1 in which said alloy composition comprises a transition metal, phosphorus, and boron.

* * * * *